United States Patent [19]

Matthews

[11] Patent Number: 5,044,026

[45] Date of Patent: Sep. 3, 1991

[54] FACE PILLOW

[76] Inventor: Donald W. Matthews, 3818 Robertson St., Houston, Tex. 77009

[21] Appl. No.: 552,950

[22] Filed: Jul. 16, 1990

[51] Int. Cl.[5] ..... A47G 9/00

[52] U.S. Cl. ..... 5/435; 5/437

[58] Field of Search ..... 5/435, 434, 437, 436, 5/441, 465, 455; D6/601; 297/391, 397

[56] References Cited

U.S. PATENT DOCUMENTS

| | | | |
|---|---|---|---|
| 716,752 | 12/1902 | Phillips | 5/455 |
| 2,556,629 | 6/1951 | O'Brien | 5/435 |
| 2,810,920 | 10/1957 | Carruth | 5/435 |
| 4,255,824 | 3/1981 | Pertchik | 5/441 |
| 4,345,345 | 8/1982 | Holtz | 5/437 |
| 4,528,981 | 7/1985 | Bemar | 5/437 |
| 4,776,049 | 10/1988 | Perron | 5/437 |

*Primary Examiner*—Alexander Grosz
*Attorney, Agent, or Firm*—Roy H. Smith, Jr.

[57] ABSTRACT

A face pillow for those persons who, whether by choice or necessity, sleep in a prone position. It consists basically of a pair of horizontally disposed cylinders of resilient material placed side-by-side on a bed or other flat surface, and a pair of straps extending around the two cylinders so that, in use position, these straps determine the width of a gap between the cylinders. The user lies with his face thrust into the pillow so that his cheeks contact the pair of cylinders, and in so doing pushes the cylinders apart. The user's nose and mouth are disposed in the gap, which affords him space for unimpeded access to fresh air. The pair of cylinders may be encased in a pair of fabric pillow slips for sanitation purposes, and the pair of straps may either completely surround both the cylinders and their pillow slips, or may, for each cylinder, enter through a top slit, extend halfway around the cylinder, and exit through a bottom slit. The straps are preferably disposed adjacent the opposed ends of the cylinders, and optionally may be used as supports for the chin and forehead. Also disclosed are buckle means in the straps for adjusting the width of the gap, and slide and loop means for moving the straps closer together along the length of the cylinders, to adjust the pillow for persons with small faces.

10 Claims, 1 Drawing Sheet

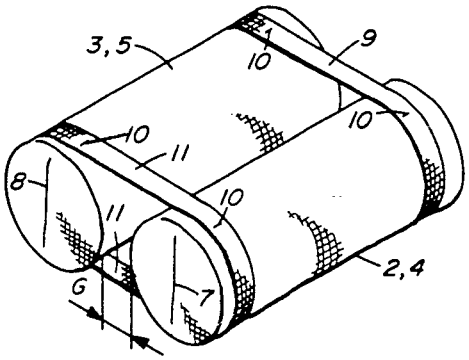
FIG. 1
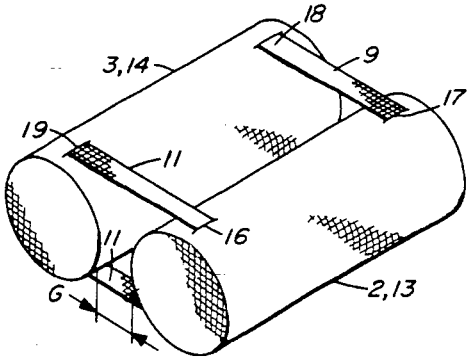
FIG. 2
FIG. 3
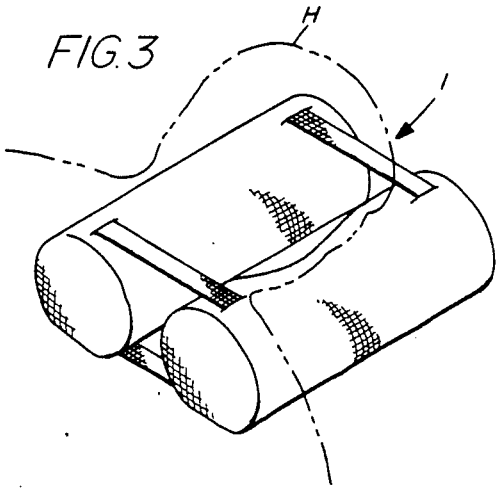
FIG. 4
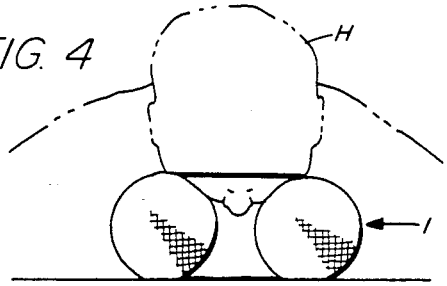
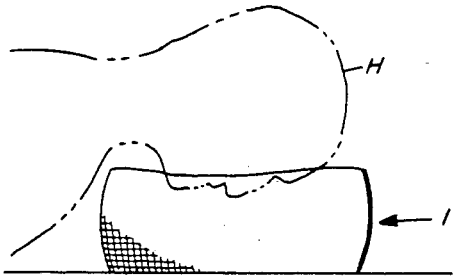
FIG. 5
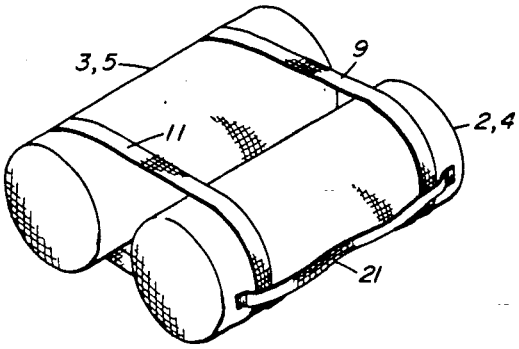
FIG. 6
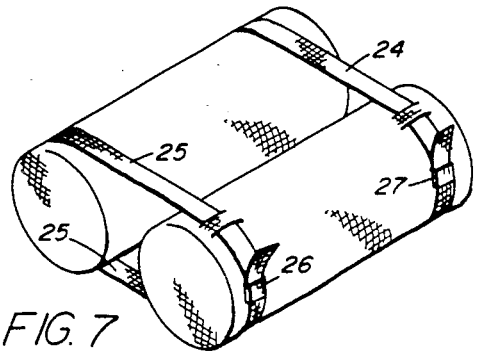
FIG. 7

FACE PILLOW

The present invention furnishes a pillow adapted to receive and support the head of a recumbent human being. More particularly, it is concerned with receiving and supporting the human head of an individual sleeping or reclining in the prone or prostrate position. Some people are obliged to recline in prone position as the result of injuries or disease, while others sleep in such position as a matter of preference. There are those, too, who sleep or rest in this position at the beach, to "get an even tan". Whatever their motives, such people will be aided by use of the present invention, which supports the head by contact with the cheeks, forehead and chin, and is particularly designed to furnish open space for breathing in the nose and mouth areas.

It is, therefore, an object of the invention to provide a pillow that will permit a human being to lie in a prone position and yet have nothing to prevent the surrounding air from reaching his or her nostrils and mouth. Heretofore many prone position sleepers have avoided the use of any and all pillows for the simple reason that such pillows tend to interfere with normal breathing, even when the sleeper lies on one or the other cheek.

A further object is to provide a pillow that can be so used by persons of all ages and genders.

A further object is to provide a pillow which can be used in many different places, e.g., on a bed or sofa, at the seashore or other beach, or even in one's back yard.

Yet another object is to provide a pillow that can be utilized by the patient of a physician who is obliged, as a part of his recovery therapy, to sleep in the prone position, either with or without other therapeutic devices.

Finally, it is an object of the invention to provide a pillow which, though designed primarily for prone position sleepers, may yet be used by supine sleepers to furnish a comfortable support at the back of the head.

BRIEF SUMMARY OF THE INVENTION

The basic pillow, the part which supports the cheeks, is bifurcated, each half consisting of a length of resilient material of about the consistency of a hard sponge, for instance foam rubber or a foamed polyurethane or similar plastic. These lengths may also be made of an inflatable material, in which event the user can inflate each half pillow to the desired stiffness. The two lengths which may be conveniently thought of as cylinders (although other cross-sections are certainly feasible) are disposed horizontally in parallel and side-by-side relationship, and are spaced apart by a distance chosen to receive the downwardly facing nose and mouth, for instance one and one-half inches for the average adult. Each of the resilient cylinders may conveniently be covered with a fabric or plastic film which is tantamount to a pillow slip; such is not indispensable to use of the pillow, but it avoids offending the squeamish and does keep the contained cylinders somewhat cleaner than might otherwise be the case. All materials including the cylinders are preferably machine washable, and in fact the entire pillow may be washed as a unit.

To maintain the desired spacing between the pair of cylinders, a pair of straps are used to surround the two cylinders, each such strap or loop having opposed semicircular ends and a pair of straight line segments between the two ends. They are preferably disposed adjacent but slightly space from the ends of the cylinders, so that one strap can contact and support the forehead while the other contacts and supports the chin. Neither of such supports seems to be strictly necessary, as the inventor has discovered that support by only the two cheeks is adequate and comfortable. These straps are preferably made of a soft material such as fabric, rather than a material with any kind of rigidity. Rigid materials tend to come into contact with the face and produce discomfort, whereas soft fabrics do not produce such a result, and are more readily cleaned by washing. Although such strap material permits the opposed cylinders to come into direct contact with one another (eliminating the needed gap) when the pillow is not in use, as soon as the user thrusts his face between the cylinders, the lateral pressure from his cheeks forces them apart to the spacing needed for breathing properly.

BRIEF DESCRIPTION OF THE DRAWING FIGURES

A drawing accompanies the present document and forms an integral part of the same. To more readily understand the present invention, the reader is urged to repair to the drawing and read the same in conjunction with the detailed description which follows below. In the drawing FIG. 1 is a perspective view of one form of the pillow of the invention, showing the pair of straps completely surrounding the pair of resilient cylinders, FIG. 2 is another perspective view of a pillow of the invention, this variant differing from that of FIG. 1 in that only the straight line segments of the connecting straps are visible, the arcuate ends passing between the cylinder and its pillow slip, FIG. 3 is also a perspective view, this being of the pillow of FIG. 1 with the head of a human being in prone position pressed into normal use position, FIGS. 4 and 5 are also views of the pillow of FIG. 1 with a human head thrust face down into the pillow, FIG. 4 being an end view and FIG. 5 an elevation, FIG. 6 is a perspective view of a pair of the resilient cylinders of the pillow invention, showing a means whereby the positions of the straps may be adjusted for small people by moving them closer together, and also showing a keeper loop for keeping the straps loosely secured to the pillow, and FIG. 7 is a perspective view of the bottom of a form of the invention showing a strap equipped with a buckle, whereby the straps may be adjusted in length to vary the size of the gap between the pair of resilient cylinders.

DETAILED DESCRIPTION OF A PREFERRED EMBODIMENT

As may be seen in FIG. 1 of the drawing, the basic part of the pillow of the invention is the pair of resilient cylinders 2 and 3 shown in their pillow slips 4 and 5. These cylinders are disposed in parallel and side-by-side relationship, as shown. They are spaced apart when in use by the gap G, which is space between a pair of vertical planes which are tangent to the inner surfaces of the cylinders at their closest approach to one another. The slits 7 and 8 shown in the near ends of the two cylinders are loading pockets for inserting or removing the rubber or plastic material that comprise cylinders 2 and 3 within pillow slips 4 and 5. The gap G is determined by the pair of straps 9 and 11, which in this form of the invention lie entirely on the outside and are sewn to the fabric of the pillow slips by the thread points marked 10. Similar sewing of straps to covering may be included as desired.

With respect to dimensions, the overall length of the pillow, i.e., along the axis of the cylinders, should correspond roughly to the length (height) of an adult head, and the cross-sectional width of the cylinders should be such that the user thrusting his face into the pillow will have his nose and mouth clear of the bed or ground or whatever surface is supporting the pillow. Representative values which the inventor has used for the resilient cylinders are a 10-inch axial length and a 4 to 5-inch diameter. The straps employed were secured to the cylinders so that the gap G was 1½ inches, which of course implies an overall width for the pillow of 9½ to 10½ inches.

The pillow shown in FIG. 2 is similar to the pillow of FIG. 1, differing therefrom in the inter-engagement of the straps and the cylinder-pillow slip combinations. In FIG. 2 both slips 13 and 14 are provided with two pairs of reinforced slits 16, 17, 18 and 19 (only the top member of each pair of slits being visible in the drawing). Each of the slits lies in a vertical plane bisecting each of the cylinders, and the slit width is wide enough to receive one of the straps 9 or 11. With this modification the curved ends of the two straps pass between the resilient cylinders and their pillow slips, while the straight line horizontal segments are open to view. The principal advantage of this form of pillow is that there is no need to sew the straps to the pillow slips.

In FIGS. 3, 4 and 5 there is shown in phantom a human head H in prone position with his or her face thrust down into a pillow 1 in normal use position. FIG. 3 is a perspective view, FIG. 4 an end elevation with the pillow 1 in a somewhat flattened condition under the weight of the head H, and FIG. 5 is a side elevation. From these figures it should be noted that the important contacts with the human head H are through the individual's pair of cheeks, and that even with the compression of the resilient cylinders there is sufficient clearance so that no part of the individual's nose or mouth contact the supporting surface for the pillow. There is ample clearance for the circulation of air through the open ends of the pillow.

FIG. 6 shows the resilient cylinder-pillow slip combinations 2 and 4 and 3 and 5 which have been provided with a keeper or loop 21. This loop 21 is sewn to the pillow slip 4 at its pair of opposed ends, and provides enough clearance at all points along its length to permit passage of the straps 9 and 11. Its principal advantage lies in the fact that the two straps may be moved closer together as desired, to accommodate the face of a child or some person with a shorter face. While such keeper 21 is shown in the drawing on only one of the pillow halves, the other half may be similarly equipped with a second keeper or loop. The principal advantage in providing keepers 21 on both halves is that it reduces the likelihood of accidental separation of the parts of the pillow. There is no need for disassembly by the user, as the entire pillow may be machine washed as an assembled unit.

FIG. 7 shows a modification which permits the user to vary the length of straps 24 and 25, and thereby to increase the gap G between the pair of cylinders, this for the reason that not all faces are of the same width and it may become desirable to change the width of the gap. To accomplish this, each strap 24 and 25 is provided with a buckle 26 or 27, which operates like any standard buckle to allow more or less of the strap length to be in tension between parts of the buckle. Of course, only one such buckle need be provided for each strap.

Having described a preferred embodiment of the present invention, it will be apparent that many variation therein are possible without departing from the scope of the inventive concept. The invention should not be narrowly construed in accordance with the particular structure described and the exemplary data furnished, but should be broadly construed to include all substantially similar means operation in substantially the same manner to achieve substantially the same results, in accordance with the following claims.

What is claimed is:

1. A face pillow consisting of a pair of resilient cylinders of about the height of an adult human face, said pair of cylinders being co-planar and parallel, and a pair of straps each secured to both said cylinders and each in the form of an endless loop, said combinations of cylinders and straps being spaced from one another by a gap adapted to receive a human face contacting the two cylinders in such manner as to force the cylinders apart, with free space in the gap around the nose and mouth of the user and keeping them elevated from any surface on which the pillow may be resting.

2. The pillow of claim 1 in which each of the resilient cylinders is enclosed in a pillow slip of soft material.

3. The pillow of claim 2 in which each of said pillow slips has a pair of slits therethrough of a width to accommodate one of said straps, each strap passing into and out of said slits so that the semi-circular ends of the straps lie between a resilient cylinder and its pillow slip covering.

4. The pillow of claim 1 in which each of said pair of straps is located adjacent one set of ends of the resilient cylinders, spaced from the ends a distance which is only a small part of the overall length of the cylinders.

5. The pillow of claim 1 in which each of said pair of straps lies entirely on the outsides of the pair of resilient cylinders.

6. The pillow of claim 1 in which the positions of the straps along the longitudinal axes of the resilient cylinders may be adjusted for the size of an individual's face, and which includes a keeper or loop having its two ends secured to one of the resilient cylinders and extending along most of its length, said straps passing under said loop and thereby preventing accidental separation of the parts.

7. The pillow of claim 1 in which each of said straps includes a buckle, whereby the gap between the resilient cylinders may be adjusted for the width of the face of the user.

8. The pillow of claim 1 in which the width of said gap is about 1½ inches.

9. A face pillow consisting of a pair of elongated resilient members horizontally disposed in parallel relationship and separated laterally by a gap, and a pair of closed, endless loop straps attached to and encircling the resilient members, said strap members having a length which determines the width of the gap between the resilient members, said gap receiving a human head in contact with the two resilient members and with free air space around the face of such human head.

10. A face pillow in two halves receiving the head of a human being thrust into the pillow with the nostrils and mouth accommodated in an air gap between the two halves, each pillow half consisting of an elongated length of a resilient material disposed horizontally and parallel to the other pillow half, and a pair of closed, endless loop straps encircling both of the pillow halves to limit the size of said gap to a size appropriate to receive said human face and support the same above any surface supporting said pillow.

* * * * *